US008715429B2

(12) United States Patent
Lee et al.

(10) Patent No.: US 8,715,429 B2
(45) Date of Patent: May 6, 2014

(54) NON-HEAT TREATED ROLLED STEEL AND DRAWN WIRE ROD WITH EXCELLENT TOUGHNESS, AND METHOD FOR MANUFACTURING THE SAME

(75) Inventors: You-Hwan Lee, Pohang (KR); Dong-Hyun Kim, Pohang (KR); Sang-Yoon Lee, Pohang (KR); Ha-Ni Kim, Pohang (KR); Yong-Sik Park, Pohang (KR)

(73) Assignee: POSCO (KR)

( * ) Notice: Subject to any disclaimer, the term of this patent is extended or adjusted under 35 U.S.C. 154(b) by 53 days.

(21) Appl. No.: 13/384,779

(22) PCT Filed: Aug. 4, 2010

(86) PCT No.: PCT/KR2010/005117

§ 371 (c)(1),
(2), (4) Date: Jan. 19, 2012

(87) PCT Pub. No.: WO2011/016676

PCT Pub. Date: Feb. 10, 2011

(65) Prior Publication Data

US 2012/0118443 A1 May 17, 2012

(30) Foreign Application Priority Data

Aug. 4, 2009 (KR) ..... 10-2009-0071586

(51) Int. Cl.

| | |
|---|---|
| ***C22C 38/02*** | (2006.01) |
| ***C22C 38/04*** | (2006.01) |
| ***C21D 8/06*** | (2006.01) |
| ***C21D 7/13*** | (2006.01) |

(52) U.S. Cl.
USPC ..... 148/320; 148/654; 148/599; 148/664

(58) Field of Classification Search
USPC ..... 148/320, 337, 645, 649, 654, 599
See application file for complete search history.

(56) References Cited

U.S. PATENT DOCUMENTS 6,264,759 B1 7/2001 Bae et al.
7,824,508 B2 11/2010 Teramoto et al.

(Continued)

FOREIGN PATENT DOCUMENTS

CN 1251865 A 5/2000
JP 58-1059 * 1/1983

(Continued)

OTHER PUBLICATIONS

Machine-English translation of Korean patent application No. 2009-06987 A, Choi et al., Jul. 1, 2009.*

*Primary Examiner* — Deborah Yee
(74) *Attorney, Agent, or Firm* — The Web Law Firm

(57) ABSTRACT

There is provided a rolled steel with excellent toughness, a drawn wire rod prepared by drawing the rolled steel, and a method for manufacturing the same, in which even if a heating step is omitted, the toughness of the steel can be improved by securing a degenerated pearlite structure in an internal structure of the rolled steel by controlling a content of Mn among components and cooling conditions, and then preventing C diffusion. The rolled steel according to the present invention includes C: 0.15~0.30%, Si: 0.1~0.2%, Mn: 1.8~3.0%, P: 0.035% or less, S: 0.040% or less, the remainder Fe, and other inevitable impurities, as a percentage of weight, in which the microstucture of the rolled steel is composed of ferrite and pearlite including cementite with 150 nm or less of thickness.

10 Claims, 2 Drawing Sheets

(56) References Cited

U.S. PATENT DOCUMENTS

| | | | |
|---|---|---|---|
| 8,404,060 | B2 | 3/2013 | Fukushima et al. |
| 2008/0156403 | A1 | 7/2008 | Masuda et al. |

FOREIGN PATENT DOCUMENTS

| | | | | |
|---|---|---|---|---|
| JP | 61-147818 | | * | 7/1986 |
| JP | 07054040 | A | | 2/1995 |
| JP | 08003640 | A | | 1/1996 |
| JP | 10008209 | A | | 1/1998 |
| JP | 10195530 | A | | 7/1998 |
| JP | 11012689 | A | | 1/1999 |
| JP | 2004137542 | A | | 5/2004 |
| JP | 2006118014 | A | | 5/2006 |
| JP | 2008163410 | A | | 7/2008 |
| WO | 2008013323 | A1 | | 1/2008 |
| WO | 2008096394 | A1 | | 8/2008 |

* cited by examiner

NON-HEAT TREATED ROLLED STEEL AND DRAWN WIRE ROD WITH EXCELLENT TOUGHNESS, AND METHOD FOR MANUFACTURING THE SAME

TECHNICAL FIELD

The present invention relates to a rolled steel and a drawn wire rod to be used as structural steel, and more specifically, to a rolled steel and a drawn wire rod with excellent toughness, in which even if a heating step is omitted, a degenerated pearlite structure can be secured in the microstructure of the rolled steel and the drawn wire rod by controlling the content of Mn and the cooling conditions thereof. In addition, the present invention relates to a method for manufacturing the rolled steel and the drawn wire rod.

BACKGROUND ART

Most structural steels are quenched and tempered steels that are realized by increasing toughness and strength through reheating, quenching, and tempering after hot working. On the contrary, a non-heat treated steel is a steel that does not undergo heat treatment after hot working, i.e., a steel having a similar toughness and strength to quality of the material to be heated (heat treated) can be obtained. The name of steel that can be used without heat treatment is a non-heat treated steel also known as micro-alloyed steel, in which the quality of the material is achieved by adding a very small alloy. Hereinafter, the steel having the properties as mentioned above will be known as a non-heat treated steel in the present invention.

Generally, a wire rod is produced as a final product by using the following steps. The final product of the wire rod can be produced in the order of Rolling Rod→Cold Drawing→Spheroidization Heat treatment→Cold Drawing→Cold Forging→Quenching and Tempering→Product. However, the non-heat treated steel is produced in order of Hot Rolling Rod→Cold Drawing→Cold Forging→Product. Therefore, the non-heat treated steel can be produced as an economical product without heat treatment process. At the same time, a final quenching and tempering steps are not performed. Therefore, the non-heat treated steel has been applied in many products due to the securing of linearity caused by not generating a heating deflection, i.e., a defect caused during the heating.

However, when the steps are processed, the strength of the product is further increased, while the toughness is continuously decreased, because the heat treatment process is omitted and cold working is continuously applied. Therefore, domestic and foreign manufacturers of a wire rod have been focused on the technology for manufacturing a non-heat treated steel with excellent toughness that has improved the toughness of non-heat treated steel. The methods for manufacturing the non-heat treated steel are methods for refining a steel grain by using a precipitate, a method for securing a composite microstructure by adding alloy elements, and the like.

Japanese Patent Laid-Open Publication No. 1995-054040 discloses a method for providing a non-heat treatment steel wire rod with 750-950 MPa of tension by hot rolling the alloy steel that is composed of C: 0.1~0.2%, Si: 0.05~0.5%, Mn: 1.0~2.0%, Cr: 0.05~0.3%, Mo: 0.1% or less, V: 0.05~0.2%, Nb: 0.005~0.03%, and the remainder Fe, as a percentage by weight, cooling the alloy steel within 60 sec between 800~600° C. for a cooling step, and heating at 450~600° C., or cooling the alloy steel after continuously maintaining it for at least 20 minutes at a temperature of between 600~450° C., and then cold working. However, the product is hot-rolled through a process, known as controlled rolling, and expensive components such as Cr, Mo, V, and the like are added in the method as mentioned above, so that it is uneconomical in use.

In addition, Japanese Patent Laid-Open Publication No. 1998-008209 relates to non-heat treated steel with excellent strength after hot working, and excellent cold formability and a method for manufacturing the same, and a method for preparing a forging member by using a non-heat treated steel, and also relates to non-heat treated steel with excellent cold formability, in which a volume of a ferrite phase is at least 40%, and a hardness is 90 HRB or less, for the steel having a controlled contents of C, Si, Mn, Cr, V, P, O, S, Te, Pb, Bi, and Ca. Specifically, the document relates to a method for continuously cooling to a temperature of Al point or less at cooling rate of 120° C. or less per minute immediately after hot-rolling to be 800~950° C. during a final working temperature, a method for cooling a hot rolled steel material in the air after heating for at least 10 minutes at 800~950° C., and also a method for preparing a structural member with 20~35 HRB of hardness by cold working or warm working at a temperature of 600° C. or less, preparing a preform, and cooling at the air after hot-forging the preform at 1000° C.~1250° C. However, the technology is limited to specific steel containing elements that are usually not used, and is not applied to cold forging.

In addition, Japanese Patent Laid-Open Publication No. 2006-118014 provides a method for manufacturing case-hardened steel that is suitable for a bolt, and the like, which suppresses grain coarsening after heat treatment, even if cold formability is excellent and also the working with a high cut rate of expanded line is performed. The method as mentioned above uses the steel material that is composed of C: 0.10~0.25%, Si: 0.5% or less (except 0%), Mn: 0.3~1.0%, P: 0.03% or less (except 0%), S: 0.03% or less (except 0%), Cr: 0.3~1.5%, Al: 0.02~0.1%, N: 0.005~0.02%, the remainder Fe, and other inevitable impurities, as a percentage by weight, and the method for manufacturing non-heat treated wire rod with excellent toughness is achieved by performing hot finish rolling or hot finish forging at 700~850° C., then cooling by up to 600° C. at a cooling rate of 0.5° C./sec or less, and suppressing below 20% of cut rate of expanded line by cooling to room temperature. The technology as mentioned above is uneconomical due to the use of expensive Cr.

SUMMARY OF THE INVENTION

An aspect of the present invention provides a rolled steel, a drawn wire rod, and a method for manufacturing the same, and more specifically, a rolled steel with excellent toughness and a drawn wire rod with excellent toughness, and a method for manufacturing the same by securing a degenerated pearlite structure in the rolled steel through the suppression of carbon diffusion by controlling the content of Mn among components and the cooling conditions thereof, even if a heating step is omitted.

According to an embodiment of the present invention, there is provided a non-heat treated steel with excellent toughness including C: 0.15~0.30%, Si: 0.1~0.2%, Mn: 1.8~3.0%, P: 0.035% or less, S: 0.040% or less, the remainder Fe, and other inevitable impurites, as a percentage by weight, in which their microstructure is composed of a pearlite and ferrite.

The microstructure of the rolled steel is preferably composed of 40~60% of the pearlite and the remainder ferrite.

The pearlite preferably includes a cementite with 150 nm or less of its thickness.

The aspect ratio (width:thickness) of the cementite included in the pearlite is preferably 30:1 or less.

The cementite included in the pearlite preferably has a discontinuous form.

The pearlite preferably is degenerated pearlite.

The rolled steel preferably has 650~750 MPa of a tensile strength and 60~70% of a reduction in area (RA).

According to another embodiment of the present invention, there is provided a drawn wire rod that is cold-drawn from the rolled steel and has 800~900 MPa of tensile strength.

According to another embodiment of the present invention, there is provided a method for manufacturing a non-heat treated rolled steel with excellent toughness, including heating a billet that includes C: 0.15~0.30%, Si: 0.1~0.2%, Mn: 1.8~3.0%, P: 0.035% or less, S: 0.040% or less, the remainder Fe, and other inevitable impurites, as a percentage by weight, to the range of $A_{e3}$+150° C.~$A_{e3}$+250° C.; primarily cooling the heated billet to the range of $A_{e3}$+50° C.~$A_{e3}$+100° C.; manufacturing a rolled steel by rolling the cooled billet at $A_{e3}$+50° C.~$A_{e3}$+100° C.; and secondarily cooling the rolled steel up to a temperature of 600° C. or less.

The heating of the billet in the heating step is preferably performed for 30 minutes to 1 and a half hours.

The cooling rate in the primary cooling step preferably is in the range of 5~15° C./s.

The cooling rate in the secondary cooling step preferably is in the range of 0.5~1.5° C./s.

According to another embodiment of the present invention, there is provided a method for manufacturing a non-heat treated rolled steel with excellent toughness including cold drawing the rolled steel.

As set forth above, according to exemplary embodiments of the present invention, the present invention can provide a non-heat treated rolled steel and a drawn wire rod that can secure excellent toughness and cold forgeability, even if a heating step is omitted by preparing a degenerated pearlite in the microstructure of the rolled steel and a drawn wire rod by controlling a cooling rate and increasing the content of Mn without the addition of expensive alloy elements.

Figure 1:
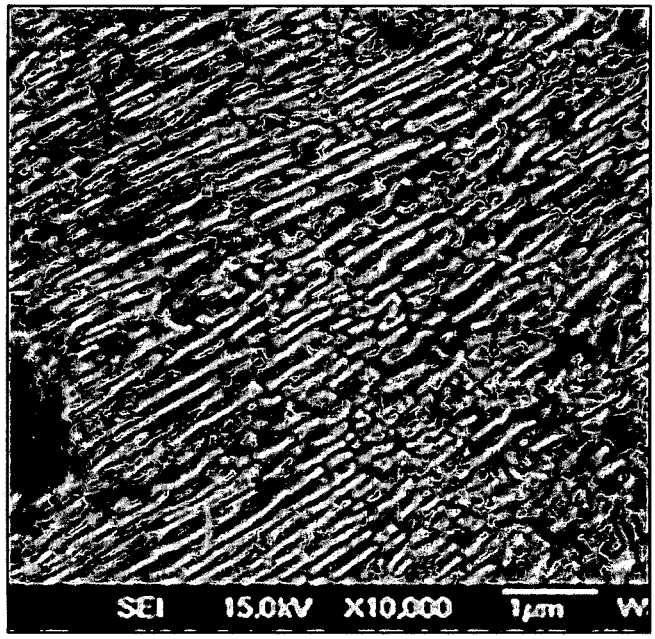
FIG. 1 is a SEM photograph showing the microstructure of Inventive Example 1.
Figure 2:
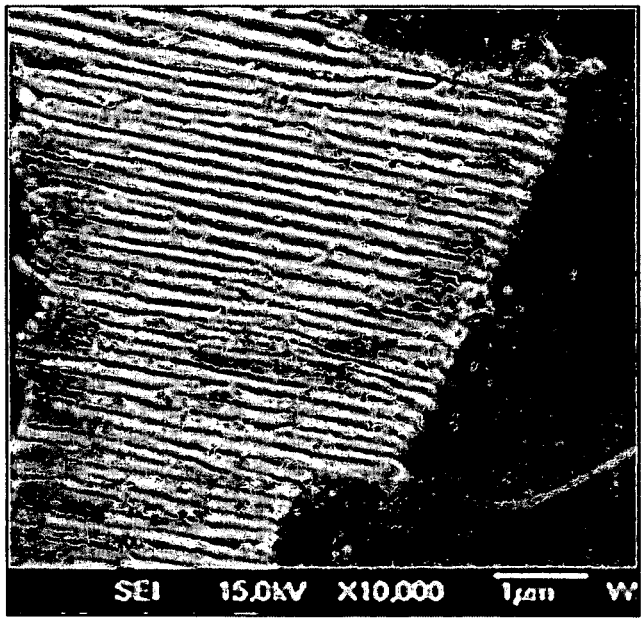
FIG. 2 is a SEM photograph showing the microstructure of general pearlite and ferrite.

A non-heat treated rolled steel is economical because the method for manufacturing the non-heat treated rolled steel does not include a heat treatment process, such as spheroidization heat treatment, and quenching and tempering after manufacturing a hot rolled steel. Specifically, the present invention provides a method for securing excellent toughness by adding a low price Mn without expensive alloy elements, combined with a proper air-cooled step.

DETAILED DESCRIPTION OF THE INVENTION

The present invention relates to the non-heat treated rolled steel, the drawn wire rod, and the method for manufacturing the same, and more specifically, the non-heat treated rolled steel, the drawn wire rod, and the method for manufacturing the same, in which Mn content in the present invention is greater than the Mn content in the existing non-heat treated steel, and a cooling rate is controlled to maximize the effect of C diffusion control according to the Mn content. The degenerated pearlite is different from the existing pearlite in the rolled steel due to the application of the method as mentioned above, so that the toughness (or impact toughness) of the product can be improved.

The rolled steel according to the present invention means a material after rolling billet, and the drawn wire rod means a material after cold drawing.

The de-generated pearlite does not have a lamellar structure, but a mixed phase of ferrite and cementite, different from general pearlite, and includes discontinuous and thin cementite. The impact toughness thereof can be increased by forming the de-generated lamellar cementite instead of a lamellar cementite, which is the cause of toughness degradation.

Generally, strength and impact toughness tend to be in inverse proportion to each other. For the rolled steel and the drawn wire rod according to the present invention, strength and impact toughness can be improved at the same time by the degenerated pearlite as mentioned above.

Hereinafter, the components and composition range of the rolled steel and the drawn wire rod according to the present invention will be described in greater detail.

C (Carbon): 0.15~0.30 wt %

C is an element improving the strength of the rolled steel. In the case that C content is below 0.15 wt %, the tensile strength of the rolled steel cannot be sufficiently secured after hot rolling. On the other hand, when C content exceeds 0.30 wt %, tendency of forming of ferrite and pearlite microstructure is also increased. Accordingly, more strength than is required is secured, thereby degrading the toughness. Therefore, the C content is preferably limited to 0.15~0.30 wt %.

Si (silicon): 0.1~0.2 wt %

In the case that Si content is below 0.1 wt %, there is a problem that the strength level that is required for hot rolled steel and the final product cannot be reached. In the case that Si content exceeds 0.2 wt %, formability is deteriorated because of sharply increasing a work-hardening during cold drawing and forging. Therefore, the Si content is preferably limited to 0.1~0.2 wt %.

Mn (Manganese): 1.8~3.0 wt %

Mn is an element for solid solution strengthening that forms substitutional solid solutions in a matrix. For this reason, Mn is a useful element as it is able to secure strength without any deterioration of toughness. The present invention is characterized by an increase of Mn content as compared to general non-heat treated steel. When Mn content is below 1.8 wt %, there is little effect on the segregation region due to the segregation of Mn, but it is hard to expect the effects of the strength securing and the toughness improving by solid solution strengthening. When Mn content exceeds 3.0 wt %, there is a harmful effect on product properties due to Mn segregation, rather than the effect of solid solution strengthening.

Macro-segregation and micro-segregation can easily occur according to segregation mechanism when solidifying steel. Mn segregation promotes a segregation region due to a relatively low diffusion coefficient as compared to other elements, thereby improving hardenability, which is a major cause of forming a core martensite. For this reason as listed above, the core martensite occurs. In this case, the tensile strength is greatly increased while toughness is sharply decreased.

P (phosphorus): 0.035 wt % or less

P is an inevitable element present when manufacturing the product. Since it is a major cause of toughness deterioration by segregating into grain boundaries, it is preferable to control the P content to be as low as possible. In theory, it is possible to limit the P content to 0%, but P is only necessarily added when manufacturing the product. It is important to control the upper limit, and the upper limit of P content is preferably limited to 0.035 wt %.

S (sulfur): 0.040 wt % or less

S is an inevitable element present when manufacturing the product. Since there is a harmful effect on the properties of stress relaxation and delayed fracture resistance due to the formation of sulphide and decreasing the toughness by segregating into grain boundaries as a low melting point element, it is preferable to control S content to be as low as possible. In theory, it is possible to limit the S content to 0%, but S is only necessarily added when manufacturing the product. It is important to control the situation, and the upper limit of S content is preferably limited to 0.040 wt %.

The microstructure of the rolled steel of the present invention is pearlite and ferrite, and a phase fraction of pearlite is 40~60% and the remainder is ferrite. The pearlite is the degenerated pearlite as mentioned above, and the degenerated pearlite is composed of cementite and ferrite, and is arranged between cementite and ferrite in parallel, but the cementite is discontinuously composed, different from a general pearlite. FIG. 1 is a SEM photograph showing the microstructure of Inventive Example 1 among the Examples of the present invention, and the discontinuous cementite form can be confirmed from FIG. 1.

Generally, pearlite may define the structure as an interlamella spacing, i.e., lamella spacing. Preferably, pearlite (degenerated pearlite) in the present invention has 150 nm or less of cementite thickness (interlamella spacing), and 30:1 or less of the mean aspect ratio (width:thickness) of cementite.

For the rolled steel with the components, the range of composition, and microstructure as mentioned above, preferably, the intended tensile strength of the rolled steel in the present invention is in the range of 650~750 MPa, and the reduction in area (RA) is 60~70%. In addition, the drawn wire rod manufactured by cold drawing the rolled steel preferably has 800~900 MPa of tensile strength.

Hereinafter, the method for manufacturing the rolled steel and the drawn wire rod according to the present invention will be described in greater detail.

Heating of Billet: $A_{e3}$+150° C.~$A_{e3}$+250° C.

By heating billet within the temperature range mentioned above, austenite single phase can be maintained, austenite grain coarsening can be prevented, and a remained segregation, carbide, and inclusion can be effectively dissolved. When the heating temperature of the billet exceeds $A_{e3}$+250° C., the austenite grain is largely coarsened, so that the wire rod with a high strength and excellent toughness cannot be achieved because the final microstructure formed after cooling has a strong tendency to be coarsened. On the other hand, when a heating temperature of billet is below $A_{e3}$+150° C., the effect occurring heating cannot be achieved.

When the heating time is below 30 minutes, there is a problem that the overall temperature is not even; when the heating time exceeds 1 and a half hours, the austenite grain is coarsened, and productivity is significantly decreased.

Cooling (Primary): Cooling to $A_{e3}$+50° C.~$A_{e3}$+100° C. at 5~15° C./s.

The cooling rate is limited with the object of minimizing the transformation of microstructure in the cooling step before hot rolling. When the cooling rate before hot rolling is below 5° C./s, the productivity thereof is reduced, and additional equipment is needed in order to maintain air-cooling. In addition, as in the case of maintaining the heating time for a long period, the strength and toughness of the rolled steel after completing hot rolling can be deteriorated. On the other hand, when the cooling rate exceeds 15° C./s, the possibility of new microstructures being formed during rolling is increased by increasing the driving force of the transformation of the billet before rolling, and serious problems can be caused, i.e., the rolling temperature should be reset to a lower temperature.

Rolling: $A_{e3}$+50° C.~$A_{e3}$+100° C.

When the rolling is performed within the range of $A_{e3}$+50° C.~$A_{e3}$+100° C., the appearance of microstructures due to transformation during rolling is suppressed, re-crystallization does not occur, and only sizing rolling is possible. When the rolling temperature is below $A_{e3}$+50° C., the intended microstructures in the present invention are difficult to acquire because the rolling temperature is close to the dynamic re-crystallization temperature, and the possibility of securing a general soft ferrite is very high. On the other hand, when the rolling temperature exceeds $A_{e3}$+100° C., there is a problem that re-heating is needed after cooling.

Cooling (Secondary): Cooling to 600° C. or less at 0.5~1.5° C./s.

The cooling rate means a cooling rate that can very effectively produce the degenerated pearlite and prevent C diffusion by adding Mn. When the cooling rate is below 0.5° C./s, since the cooling rate is too slow, the lamella or degenerated pearlite cannot be produced, and cementite with a spheroidized form is produced, so that the strength thereof is sharply decreased. In this case, since the toughness becomes very high, it can be effectively applied to other products, but it is not intended for the present invention. However, when the cooling rate exceeds 1.5° C./s, a low temperature structure, such as martensite/bainite can occur because ferrite/pearlite transformation is delayed due to the improvement of the hardenability by adding Mn.

After the cooling (Secondary), the drawn wire rod can be produced through general cold drawing.

Hereinafter, the present invention will be described in detail with reference to the following Examples.

EXAMPLE

Rolled steels were produced with Steel Types 1 to 9 as described in the following Table 1, according to the manufacturing condition as described in the following Table 2. Steel Types 1-3, Steel Types 8 and 9 were not satisfied with the components and the composition range that were controlled according to the present invention, and Steel types 4-7 were satisfied with the components and the composition range that were controlled according to the present invention.

In addition, $A_{e3}$ (° C.) in each Steel Type were shown in Table 1, and the tensile strength and V-impact toughness of the rolled steel produced according to the manufacturing condition were measured, and then shown in the following Table 2.

And, SEM photographs of microstructures of Inventive Example 1, Comparative Example 1, and Comparative Example 7 were shown in figures.

TABLE 1

| STEEL TYPE | C(WT %) | Si(WT %) | Mn(WT %) | P(WT %) | S(WT %) | $Ae_3$(° C.) |
|---|---|---|---|---|---|---|
| STEEL TYPE1 | 0.14 | 0.11 | 1.9 | 0.031 | 0.023 | 863 |
| STEEL TYPE2 | 0.22 | 0.05 | 1.8 | 0.030 | 0.032 | 855 |
| STEEL TYPE3 | 0.21 | 0.10 | 1.5 | 0.031 | 0.039 | 851 |
| STEEL TYPE4 | 0.20 | 0.10 | 1.8 | 0.035 | 0.040 | 842 |
| STEEL TYPE5 | 0.20 | 0.15 | 1.9 | 0.031 | 0.031 | 838 |
| STEEL TYPE6 | 0.26 | 0.14 | 2.0 | 0.021 | 0.022 | 836 |
| STEEL TYPE7 | 0.30 | 0.20 | 3.0 | 0.027 | 0.039 | 835 |
| STEEL TYPE8 | 0.31 | 0.20 | 3.4 | 0.029 | 0.034 | 833 |
| STEEL TYPE9 | 0.35 | 0.19 | 2.6 | 0.029 | 0.028 | 829 |

TABLE 2

| | | BILLET HEATING TEMPERATURE (° C.) | HEATING TIME (MIN) | COOLING RATE (° C./s) | ROLLING TEMP. (° C.) | COOLING RATE AFTER ROLLING (° C./s) | TENSILE STRENGTH OF ROLLED STEEL (MPa) | V-IMPACT TOUGHNESS OF ROLLED STEEL (J) |
|---|---|---|---|---|---|---|---|---|
| INVENTIVE EXAMPLE 1 | STEEL TYPE4 | 1082 | 80 | 9.7 | 989 | 1.3 | 652 | 256 |
| COMPARTIVE EXAMPLE 1 | STEEL TYPE4 | 1090 | 62 | 13.2 | 956 | 0.2 | 531 | 326 |
| INVENTIVE EXAMPLE 2 | STEEL TYPE4 | 1015 | 71 | 11.9 | 978 | 0.5 | 653 | 261 |
| INVENTIVE EXAMPLE 3 | STEEL TYPE4 | 1065 | 65 | 10.2 | 988 | 0.9 | 676 | 235 |
| INVENTIVE EXAMPLE 4 | STEEL TYPE4 | 1011 | 88 | 9.6 | 990 | 1.5 | 681 | 221 |
| COMPARTIVE EXAMPLE 2 | STEEL TYPE4 | 1083 | 78 | 13.9 | 991 | 2.3 | 897 | 32 |
| INVENTIVE EXAMPLE 5 | STEEL TYPE5 | 1038 | 19 | 10.2 | 972 | 0.8 | 663 | 248 |
| COMPARTIVE EXAMPLE 3 | STEEL TYPE5 | 1082 | 82 | 11.7 | 965 | 0.3 | 546 | 365 |
| INVENTIVE EXAMPLE 6 | STEEL TYPE5 | 1053 | 82 | 12.4 | 978 | 0.6 | 659 | 223 |
| INVENTIVE EXAMPLE 7 | STEEL TYPE5 | 1065 | 89 | 10.2 | 981 | 1.1 | 675 | 232 |
| COMPARTIVE EXAMPLE 4 | STEEL TYPE5 | 1071 | 79 | 9.1 | 980 | 1.7 | 873 | 41 |
| COMPARTIVE EXAMPLE 5 | STEEL TYPE5 | 1069 | 80 | 14.2 | 968 | 1.9 | 901 | 15 |
| COMPARTIVE EXAMPLE 6 | STEEL TYPE1 | 1063 | 82 | 7.5 | 1005 | 0.6 | 520 | 340 |
| COMPARTIVE EXAMPLE 7 | STEEL TYPE2 | 1055 | 89 | 8 | 998 | 0.9 | 558 | 352 |
| COMPARTIVE EXAMPLE 8 | STEEL TYPE3 | 1051 | 75 | 9.3 | 965 | 1.2 | 589 | 312 |
| INVENTIVE EXAMPLE 8 | STEEL TYPE6 | 1036 | 88 | 10.6 | 976 | 0.7 | 678 | 252 |
| INVENTIVE EXAMPLE 9 | STEEL TYPE7 | 1035 | 71 | 9.5 | 962 | 1.1 | 102 | 234 |
| COMPARTIVE EXAMPLE 9 | STEEL TYPE8 | 1033 | 69 | 12.1 | 980 | 1.0 | 892 | 46 |
| COMPARTIVE EXAMPLE 10 | STEEL TYPE9 | 1029 | 68 | 11.5 | 968 | 0.9 | 920 | 13 |

Figure 4:
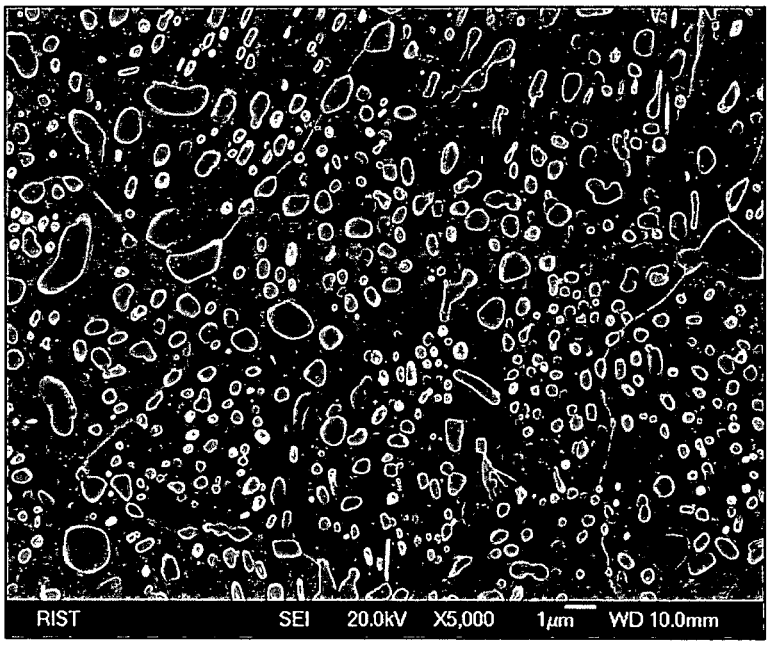
FIG. 4 is a SEM photograph showing the microstructure of Comparative Example 1.

In Comparative Examples 1 and 3, the degenerated pearlite could not be produced because the cooling rate after rolling was low, and cementite with a spheroidized form was produced, thereby decreasing strength. In addition, the photograph of the microstructure of the Comparative Example 1 was shown in FIG. 4, and the spheroidized cementite could be confirmed through FIG. 4. In Comparative Examples 2, 4 and 5, the cooling rate after rolling was high, so that the low temperature structure could occur, thereby deteriorating toughness.

Figure 3:
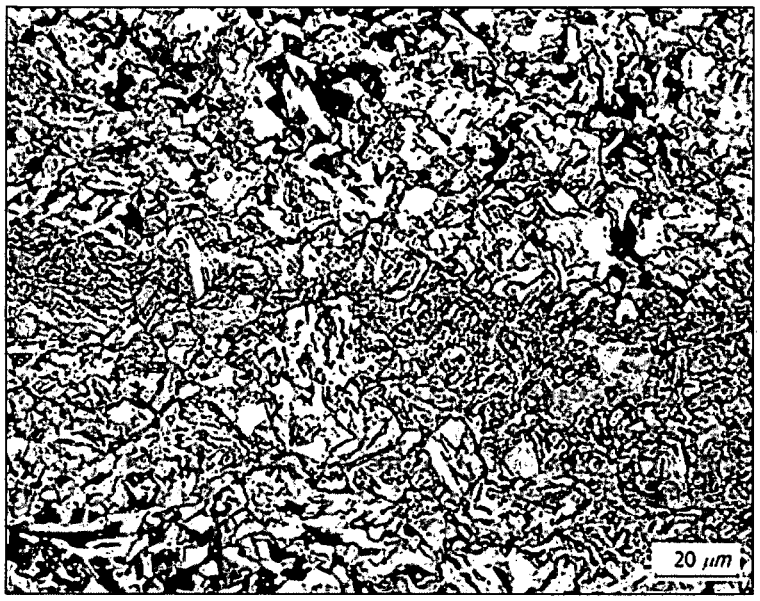
FIG. 3 is a SEM photograph showing the microstructure of Comparative Example 9, in which a content of Mn exceeds the range that is limited in the present invention.

In Comparative Example 6, the tensile strength after rolling could not be sufficiently secured because the C content was low. In Comparative Example 7, sufficient strength could not be secured because the Si content was low. In Comparative Example 8, the improvement of the strength by solid-solution strengthening was difficult because Mn content was low. It could be confirmed that the low temperature structure could occur due to a high Mn content, so that the toughness was sharply decreased in Comparative Example 9. The low temperature structure could be confirmed through FIG. 3. In Comparative Example 10, the C content was high, and the formation of a general ferrite and pearlite microstructure was strong, so that the strength was improved, but the toughness was reduced.

On the other hand, in Inventive Examples 1 to 9, the tensile strength of the rolled steel was in the range of 650~750 MPa, and V-impact toughness value, the impact toughness was 221-261J, and it could be confirmed that the tensile strength and toughness were excellent. For this reason, the proper tensile strength and excellent toughness could be secured by controlling the components, the composition range, and the manufacturing conditions.

The invention claimed is:

1. A non-heat treated rolled steel with excellent toughness, comprising C: 0.15~0.30%, Si: 0.1~0.2%, Mn: 1.8~3.0%, P: 0.035% or less, S: 0.040% or less, the remainder Fe, and other inevitable impurities, as a percentage of weight, wherein microstuctures in the non-heat treated rolled steel are composed of 40-60% of pearlite and the remainder ferrite, and wherein the pearlite is a degenerated pearlite.

2. The non-heat treated rolled steel with excellent toughness of claim 1, wherein the pearlite includes cementite with 150 nm or less of thickness.

3. The non-heat treated rolled steel with excellent toughness of claim 1, wherein an aspect ratio (width:thickness) of the cementite included in the pearlite is 30:1 or less.

4. The non-heat treated rolled steel with excellent toughness of claim 1, wherein the cementite included in the pearlite has a discontinuous form.

5. The non-heat treated rolled steel with excellent toughness of claim 1, wherein the rolled steel has 650~750 MPa of a tensile strength and 60~70% of a reduction in area (RA).

6. A non-heat treated drawn wire rod with excellent toughness produced by cold drawing the rolled steel of claim 1, wherein the drawn wire rod has 800~900 MPa of a tensile strength.

7. A method for manufacturing a non-heat treated rolled steel with excellent toughness, comprising:

heating a billet that includes C: 0.15~0.30%, Si: 0.1~0.2%, Mn: 1.8~3.0%, P: 0.35% or less, S: 0.040% or less, the remainder Fe, and other inevitable impurities, as a percentage of weight, to the range of $A_{e3}$+150° C.~$A_{e3}$+250° C.;

primarily cooling the heated billet to the range of $A_{e3}$+50° C.~$A_{e3}$+100° C., wherein the cooling rate is in the range of 5~15° C./s;

manufacturing the rolled steel by rolling the cooled billet at $A_{e3}$+50° C.~$A_{e3}$+100° C.; and secondarily cooling the rolled steel to a temperature of 600° C. or less.

8. The method for manufacturing a non-heat treated rolled steel with excellent toughness of claim 7, wherein the heating of the billet in the heating step is performed for 30 minutes to 1 and a half hours.

9. The method for manufacturing a non-heat treated rolled steel with excellent toughness of claim 7, wherein the cooling rate in the secondary cooling step is in the range of 0.5~1.5° C./s.

10. A method for manufacturing a non-heat treated drawn wire rod with excellent toughness, comprising: cold drawing the rolled steel of claim 7.

* * * * *

UNITED STATES PATENT AND TRADEMARK OFFICE

CERTIFICATE OF CORRECTION

PATENT NO. : 8,715,429 B2
APPLICATION NO. : 13/384779
DATED : May 6, 2014
INVENTOR(S) : You-Hwan Lee et al.

It is certified that error appears in the above-identified patent and that said Letters Patent is hereby corrected as shown below:

On the Title Page of the Patent, Column 2, Item (57) Abstract, Line 11, delete "impurites" and insert -- impurities --

On the Title Page of the Patent, Column 2, Item (57) Abstract, Line 12, delete "microstuctures" and insert -- microstructures --

In the Claims

Column 9, Line 9, Claim 1, delete "microstuctures" and insert -- microstructures --

Signed and Sealed this
Nineteenth Day of August, 2014

Michelle K. Lee

Michelle K. Lee
*Deputy Director of the United States Patent and Trademark Office*